US008496091B2

(12) United States Patent
Wu

(10) Patent No.: US 8,496,091 B2
(45) Date of Patent: Jul. 30, 2013

(54) ELEVATOR CAR LAYOUT INFORMATION EDITING SYSTEM, DESTINATION INFORMATION INPUT DEVICE, DISPLAY DEVICE AND EDITION OPERATING DEVICE

(75) Inventor: Wei Wu, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 315 days.

(21) Appl. No.: 13/055,369

(22) PCT Filed: Jul. 23, 2008

(86) PCT No.: PCT/JP2008/063167

§ 371 (c)(1),
(2), (4) Date: Jan. 21, 2011

(87) PCT Pub. No.: WO2010/010612

PCT Pub. Date: Jan. 28, 2010

(65) Prior Publication Data

US 2011/0127118 A1 Jun. 2, 2011

(51) Int. Cl.
*B66B 1/34* (2006.01)

(52) U.S. Cl.
USPC ..... 187/396; 187/391

(58) Field of Classification Search
USPC ... 187/247, 248, 380–388, 391–397; 704/270
See application file for complete search history.

(56) References Cited

U.S. PATENT DOCUMENTS 5,844,181 A 12/1998 Amo et al.
6,082,500 A 7/2000 Amo et al.
6,250,428 B1 6/2001 Amo et al.
6,945,365 B2 * 9/2005 Matela ..... 187/382
6,962,240 B2 * 11/2005 DiFranza et al. ..... 187/393

(Continued)

FOREIGN PATENT DOCUMENTS

CN 100999296 A 7/2007
JP 01242379 A * 9/1989
JP 4-169484 6/1992
JP 8-192964 7/1996
JP 2006-256724 9/2006

OTHER PUBLICATIONS

Combined Chinese Office Action and Search Report issued Sep. 29, 2012, in Patent Application No. 200880129915.5 (with partial English-language translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator car layout information editing system 1000 includes a riding car display device 300 and a car layout information editing device 400. The riding car display device 300 stores at least one piece of car layout information showing planar layout of plural elevator cars at a transverse section of a building, displays the above car layout information, and as well carries out an editing process of the displayed car layout information according to an edition instructing signal to instruct the editing process of the above car layout information. The car layout information editing device 400 receives an editing operation for the above car layout information displayed by the riding car display device 300, generates the edition instructing signal to instruct the editing process corresponding to the received editing operation, and sends the generated edition instructing signal to the display device.

8 Claims, 8 Drawing Sheets

U.S. PATENT DOCUMENTS

| | | | | |
|---|---|---|---|---|
| 7,040,458 | B2 * | 5/2006 | Forsythe et al. | 187/396 |
| 7,278,518 | B2 * | 10/2007 | Newville et al. | 187/396 |
| 7,328,775 | B2 * | 2/2008 | Zaharia et al. | 187/396 |
| 7,353,915 | B2 * | 4/2008 | Zaharia et al. | 187/388 |
| 8,069,957 | B2 * | 12/2011 | Miyajima et al. | 187/391 |
| 8,290,781 | B2 * | 10/2012 | Gazdzinski | 704/275 |
| 8,370,158 | B2 * | 2/2013 | Gazdzinski | 704/270 |
| 2002/0007987 | A1 | 1/2002 | Amo et al. | |
| 2004/0055830 | A1 | 3/2004 | Amo et al. | |
| 2005/0056494 | A1 | 3/2005 | Amo et al. | |
| 2006/0006026 | A1 | 1/2006 | Amo et al. | |
| 2008/0006487 | A1 | 1/2008 | Amo et al. | |

OTHER PUBLICATIONS

Korean Office Action issued May 15, 2012, in Korea Patent Application No. 10-2010-7028140 (with English translation).

International Search Report issued Apr. 7, 2009, in PCT/JP2008/063167.

Office Action dated Mar. 11, 2013, in Chinese Patent Application No. 200880129915.5 (with partial English-language translation), 13 pages.

* cited by examiner

ELEVATOR CAR LAYOUT INFORMATION EDITING SYSTEM, DESTINATION INFORMATION INPUT DEVICE, DISPLAY DEVICE AND EDITION OPERATING DEVICE

TECHNICAL FIELD

The present invention relates to, a car layout information editing system for editing car layout information showing a planar layout of plural elevator cars in a transverse section of a building, and a destination information input device, a display device, and an editing operation device.

BACKGROUND ART

For example, in an elevator hall operation board using a numeric keypad as shown in the U.S. Pat. No. 7,040,458, it is expected to improve the general operation efficiency by indicating an elevator car to ride to a passenger with respect to the destination floor inputted by operation of a numeric keypad of the passenger based on operation status of plural elevators at an elevator group management side. In order to indicate an elevator car to ride to the passenger, the destination floor inputted by the passenger and a name of the elevator car (a name such as "A" car, "B" car, No. 1 car, and No. 2 car) are displayed on a display device (in general, a dot LED is used) in the conventional elevator hall operation board.

Recent years, through popularization of a liquid crystal display device, as shown in the U.S. Pat. No. 7,040,458, a riding car indication to the passenger has become easier to understand by also showing a planar layout of elevator cars (a car layout in short, hereinafter, which is the same meaning as car layout information which will be discussed later). The car layout, or the car layout information is the layout or the assignment information showing the planar layout of plural elevator cars in a transverse section of a building.

Patent Literature 1: U.S. Pat. No. 7,040,458

DISCLOSURE OF THE INVENTION

Technical Problem

However, the car layout has been conventionally generated in the following two methods.

(1) a method in which some standard patterns of car layout have been prepared. Namely, standard layout patterns are previously stored in the display device.

(2) a method in which construction is worked according to the actual car layout of the site. Namely, data of the car layout (car layout information) is produced for a particular building and stored in the display device.

In the method of (1), the assignment patterns which have been previously prepared are limited, so that the prepared pattern may not be applied to the actual car layout of the site. Further, even if the configuration of the layout of the site is not deviated from the patterns which have been previously prepared, in most cases, the detailed expression such as expression of the distance to the car from the providing position of the elevator hall operation board cannot be fully expressed by the prepared patterns. Because of this, the riding car indication to the passenger becomes hard to understand on the contrary.

Further, in the method of (2), it is possible to carry out a design matched to the actual layout of the site (generate the matched car layout data); however, the cost of design becomes expensive, so that it is implemented only for the limited objects.

The present invention aims to provide a car layout information editing system which can edit car layout information with a simple configuration.

Solution to Problem

According to the present invention, an elevator car layout information editing system includes:

a display device including:

a display unit for displaying information;

a display information storage unit for storing at least one piece of car layout information showing planar layout of a plurality of elevator cars in a transverse section of a building as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information, and an editing operation device including:

an editing operation inputting unit for receiving an editing operation for the car layout information displayed by the display unit; and an input controlling unit for generating the edition instructing signal to instruct the editing process corresponding to the editing operation received by the editing operation inputting unit, and sending the edition instructing signal generated to the display controlling unit of the display device.

The display information storage unit stores the car layout information after the editing process which has been carried out by the display controlling unit, and the editing operation device further includes an editing side storage unit for storing car layout information which is same as the car layout information after the editing process stored in the display information storage unit.

The display information storage unit stores the car layout information after the editing process which has been carried out by the display controlling unit, and the editing operation device further includes:

an editing side storage unit for storing information; and a reading unit for reading the car layout information after the editing process stored in the display information storage unit, and storing the car layout information after the editing process which has been read in the editing side storage unit.

The editing operation device further includes a writing unit, by connecting to a new one of the display device, for writing the car layout information after the editing process stored in the editing side storage unit in the display information storage unit of the new one of the display device.

The display information storage unit and the editing side storage unit are removable.

According to the present invention, a destination information input device provided at an elevator hall receiving an input of a destination floor includes:

a display unit for displaying information;

a display information storage unit for storing at least one piece of car layout information showing planar layout of a plurality of elevator cars in a transverse section of a building as display information to be displayed by the display unit;

a display controlling unit for displaying the car layout information stored in the display information storage unit by the display unit, and as well carrying out an editing process of the car layout information displayed by the display unit according to an edition instructing signal to instruct the editing process of the car layout information;

an editing operation inputting unit for receiving an editing operation for the car layout information displayed by the display unit; and an input controlling unit for generating the edition instructing signal to instruct the editing process corresponding to the editing operation received by the editing operation inputting unit, and sending the edition instructing signal generated to the display controlling unit.

According to the present invention, a display device provided at an elevator hall displaying car layout information showing planar layout of a plurality of elevator cars in a transverse section of a building includes:

a display unit for displaying information;

a display information storage unit for storing at least one piece of car layout information as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information.

According to the present invention, an editing operation device includes:

an editing operation inputting unit for receiving an editing operation for car layout information displayed by a displaying unit of a display device including:

the display unit for displaying information;

a display information storage unit for storing at least one piece of car layout information showing planar layout of a plurality of elevator cars in a transverse section of a building as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information, and an input controlling unit for generating the edition instructing signal to instruct the editing process corresponding to the editing operation received by the editing operation inputting unit, and sending the edition instructing signal generated to the display controlling unit of the display device.

Advantageous Effects of Invention

According to the present invention, it is possible to provide a car layout information editing system which can edit car layout information with a simple configuration.

BEST MODE FOR CARRYING OUT INVENTION

Embodiment 1

First, the terms which will be used in the following first embodiment are defined.

(1. Car Layout Information)

"Car layout information" means information showing a planar layout of plural elevator cars in a transverse section of a building. Namely, it is the planar layout of the cars at the elevator hall. FIG. 10 which will be discussed later shows that a display unit 510 displays the car layout information. As shown by the display unit 510 of FIG. 10, "car layout information" means the car assignment in the elevator hall when the building is cut along the transverse section, looking down the elevator hall from the upward of the cut surface. As shown in FIG. 10, "car layout information" can include assignment of a passage or an operation board, etc. other than the car assignment.

(2. Configurational Item)

Like the car layout information displayed on the display unit 510 in FIG. 10, the car layout information is configured by "configurational items" which configure the car layout information. Here, "configurational item" means picture symbols such as a picture symbol 1 of the car, a picture symbol 2 of an operation board, and a picture symbol 3 of a passage and a car identifying character 4 for identifying cars such as A, B, etc.

(3. Relating Information)

"Relating information" is information relating the car identifying character or the picture symbol to the actual car. For example, in the display unit 510 of FIG. 10, when "A" car is assigned, or "A" car arrives at the elevator hall, the car identifying character "A" is made blinking, etc. As discussed above, for example, information relating the actual "A" car to the car identifying character "A" (or the picture symbol corresponding to "A") is the relating information. Namely, a riding car display device 300 which will be discussed later in FIG. 1 inputs a signal from the riding car selecting device 200 (or the elevator control device), the inputted signal is made related to the picture symbol or the car identifying character by the relating information.

(4. Display Instruction)

"Display instruction" (an edition instructing signal) is a signal to instruct an editing process corresponding to the editing operation received by an editing operation inputting unit 410. The display instruction is generated by a microcomputer 440 (the microcomputer, hereinafter, the microcomputer) using an input controlling unit 420.

(System Configuration)

FIG. 1 shows a general configuration diagram of an elevator hall riding car guiding system 2000 of the first embodiment. The elevator hall riding car guiding system 2000 includes a destination information input device 100, a riding car selecting device 200, a riding car display device 300 (display device), and further a car layout information editing device 400 (editing operation device). The riding car display device 300 and the car layout information editing device 400 constitute the car layout information editing system 1000. The elevator hall riding car guiding system 2000 is characterized by the car layout information editing system 1000. Further, the riding car display device 300 is able to communicate with the riding car selecting device 200 and plural elevator control devices A to N, etc.

(1) The destination information input device 100 is provided at the elevator hall and receives an input of a destination floor from a user. The destination information input device 100 is sometimes also called as an elevator hall operation board or a destination call registration device. The destination information input device 100 includes inputting means (for example, separate destination floor buttons, a numeric keypad, a card reader, etc.). The passenger inputs a destination floor using the inputting means at the elevator hall.

(2) The riding car selecting device 200 is a device to select the elevator car to let the passenger to ride based on the destination floor inputted by the destination information input device 100 with considering the operation status of plural elevators, so that the operation becomes the most effective as a whole. The riding car selecting device 200 is sometimes also called as a group management control device.

(3) The riding car display device 300 is a device to display the car layout information which will be discussed later and as well display a car to ride by the user. A detail will be discussed later.

(4) The car layout information editing device 400 is a device to edit the car layout information. The car layout information editing device 400 can be configured to be always connected to the riding car display device 300. Or, the car layout information editing device 400 can be also configured to be removable from the riding car display device 300, and can be connected to the riding car display device 300 only at the time of editing the car layout information.

(Utilization Form of Car layout information Editing System 1000) The elevator hall riding car guiding system 2000 is characterized by the car layout information editing system 1000. Next, utilization form of the car layout information editing system 1000 will be explained using FIG. 2 to FIG. 4.

FIG. 2 is a diagram showing a basic form of utilization. FIG. 2 shows a case in which the car layout information editing device 400 edits template information 11 stored in the riding car display device 300*a*. The template information 11 is car layout information to be used as a template which is previously stored as factory default. As factory default setting, the riding car display device 300*a* stores the template information 11. Then, at the time of installing the elevator, the template information 11 is edited by the car layout information editing device 400, so that the car layout information 12 matched to the building can be edited at the installation site.

FIG. 3 shows a form in which the car layout information editing device 400 stores the edited car layout information 12 when the template information 11 of the riding car display device 300 is edited by the car layout information editing device 400 in FIG. 2. The figure shows a case in which the car layout information editing device 400 stores the car layout information 12 which is the same as the edited car layout information 12 set in the riding car display device 300*a*, and the stored car layout information 12 can be written in the other riding car display devices 300*b* to 300*n*, etc. By this operation, it is possible to eliminate the labor of editing operation for the riding car display device 300*b*, etc.

FIG. 4 shows a case in which the riding car display device 300*a* becomes faulty at the time of normal operation. At this time, the figure shows that the car layout information editing device 400 can read the car layout information 12 from the faulty riding car display device 300*a*. Then, the car layout information editing device 400 stores the car layout information 12 which has been read in a new riding car display device 300*new*. By this operation, it is possible to eliminate the labor of editing operation for the new riding car display device 300*new*. Further, when it is impossible to read the car layout information 12 from the riding car display device 300*a*, the car layout information 12 which is the same as the one stored in the riding car display device 300*a* can be read from a riding car display device 300*b*, and written in the riding car display device 300*new*.

FIG. 5 shows a case in which the riding car display device 300*a* becomes faulty at the time of normal operation similarly to FIG. 4. The storage units of the riding car display device 300*a* and the riding car display device 300*new* (the storage unit for storing the car layout information) is configured to be removable from the device. Namely, a worker removes the storage unit of the faulty riding car display device 300*a* and attaches the storage unit to a new riding car display device 300*new*. By this operation, it is possible to eliminate the labor of editing operation for the new riding car display device 300*new*.

(Configuration of Riding Car Display Device 300)

FIG. 6 is a block diagram showing a configuration of the riding car display device 300. The riding car display device 300 includes a display unit 310, a display controlling unit 320, a display information storage unit 330, a communicating unit 340, a microcomputer 350, and a memory 360.

(1) The display unit 310 displays the destination information inputted from the destination information input device 100, the car layout information, a car identifying character such as A, or B, etc. to identify a car to ride, a picture symbol showing a car or a passage, etc.

(2) The display controlling unit 320 controls the display unit 310.

(3) The display information storage unit 330 stores the car layout information configured by the configurational item, another configurational item which is different from the configurational item configuring the car layout information (for example, a configurational item used for editing the car layout information which is currently stored), and relating information for relating the car identifying character or the picture symbol which is the configurational item to the actual elevator car (for example, the character A shows the "A" car; the picture symbol of "F" shows the "F" car, etc.). At the time of factory shipment, at least one template of the car layout information which is assumed to be edited (template information) is stored as the car layout information to be stored in the display information storage unit 330. At the time of installing the elevator, the template information is edited. However, the item to be edited is not limited to the template information, but it is possible to edit again the car layout information which has been edited as the subject to be edited.

(4) The communicating unit 340 controls the communication.

(5) The microcomputer 350 controls the display unit 310, the display controlling unit 320, the display information storage unit 330, the communicating unit 340, and the memory 360, etc.

(6) The memory 360 stores a program of the microcomputer 350 (also used as a working memory).

(Memory 360, Display Information Storage Unit 330)

The memory 360 for storing programs and the display information storage unit 330 can be configured by any memory device or any memory element such as a hard disk drive, a non-volatile memory, a memory which needs constant writing and maintaining operation, etc., or also can be configured by some pieces of the above as the same memory device or elements. Further, in the microcomputer 350, other than the display unit 310, the display controlling unit 320, the display information storage unit 330, the communicating unit 340, and the memory 360 can be embedded. Further, the display information storage unit 330 can be, as explained in FIG. 5, a removable non-volatile storage.

(Display Unit 310)

The display unit 310 can be any displaying device as long as it can display characters or pictures such as a liquid crystal display, a plasma display, an LED (Light Emitting Diode), a cathode-ray tube, etc.

(Microcomputer 350, Display Controlling Unit 320)

The microcomputer 350 operates based on the program stored in a memory 360 for storing the program using the working memory. The microcomputer 350 receives the information of the assigned car notified by the riding car selecting device 200 or the information of the destination floor notified by the elevator control devices A to C, etc. through the communicating unit 340. Then, in response to the information, the information to display (the car layout information) stored in the display information storage unit 330 is extracted and sent (controlled) to the display controlling unit 320, and thereby characters or pictures are displayed on the display unit 310.

(Communicating Unit 340)

For the communicating unit 340, any communication method can be employed as long as it is able to transmit information regardless whether the form is wired or wireless.

(Configuration of Car Layout Information Editing Device 400)

FIG. 7 is a block diagram of the car layout information editing device 400 (an editing operation reception device). The car layout information editing device 400 includes an editing operation inputting unit 410, an input controlling unit 420, a communicating unit 430, a microcomputer 440 (an example of a reading unit, an example of a writing unit), a memory 450, and a car layout information storage unit 460 (an example of an editing side storage unit).

(1) The editing operation inputting unit 410, when arranging and displaying on the display unit 310 of the riding car display device 300, can arrange vertically and horizontally the car identifying character and the picture symbol such as a car or a passage, etc. which configures the car layout information.

(2) The input controlling unit 420 controls the editing operation inputting unit 410.

(3) The communicating unit 430 controls the communication.

(4) The microcomputer 440 controls the editing operation inputting unit 410, the input controlling unit 420, the communicating unit 430, the memory 450, and the car layout information storage unit 460, etc.

(5) The memory 450 is a memory for storing programs of the microcomputer 440 and for working.

(6) The car layout information storage unit 460 stores the car layout information.

(Memory 450, Car Layout Information Storage Unit 460)

The memory 450 for storing programs and the car layout information storage unit 460 can be configured by any memory device or any memory element such as a hard disk drive, a non-volatile memory, a memory which needs constant writing and maintaining operation, etc., or also can be configured by some pieces of the above as the same memory device or elements. In the microcomputer 440, other than the editing operation inputting unit 410, the input controlling unit 420, the communicating unit 430, the memory 450, the car layout information storage unit 460 can be embedded. Further, the car layout information storage unit 460 can be a removable non-volatile storage.

(Editing Operation Inputting Unit 410)

The editing operation inputting unit 410 can be any inputting device such as a button, a switch, a joystick, and a touch screen, etc. Any device can be employed as long as such device can at least indicate (operate) to select and decide items of the configuration element of the car layout information such as the picture symbol or the car identifying character. FIG. 7 shows the editing operation inputting unit 410-1 and the editing operation inputting unit 410-2 as the editing operation inputting unit. FIG. 7 shows a case in which the editing operation inputting unit 410-1 is used; however, it also shows, instead of the editing operation inputting unit 410-1, the editing operation inputting unit 410-2 can be used. The editing operation inputting unit 410-1 has two selection buttons and one decision button. The editing operation inputting unit 410-2 has four selection buttons (up/down/left/right) and one decision button. The editing operation inputting unit 410-1 is used mainly for arranging the picture symbol, etc. of the elevator car horizontally to the location which has been previously decided (not only arranging horizontally, but a case is also considered for arranging to the left end of a new line by automatically beginning the new line when the symbol, etc. is arranged to the right end). In the editing operation inputting unit 410-2, there is no limitation for arranging the location of the picture symbol, etc. The editing operation inputting unit 410-2 can arrange (the editing operation) freely vertically and horizontally the picture symbol, the car identifying character, etc. on the display unit 310.

(Microcomputer 440)

The microcomputer 440 operates based on the programs stored in the memory 450 for storing programs (which also works as a working memory) using the working memory. The microcomputer 440, using the input controlling unit 420, generates a display instruction (an edition instructing signal) to instruct "the editing process corresponding to the editing operation received by the editing operation inputting unit 410" and sends to the riding car display device 300 through the communicating unit 430. On the other hand, the riding car display device 300 displays the template information 11 (the car layout information) to be edited on the display unit 310. While viewing the template information 11 displayed by the display unit 310, the worker can edit the template information 11 and generate the desired car layout information. Further, the car layout information which has been edited like the above and decided finally is stored in the car layout information storage unit 460 by the microcomputer 440. In addition, the microcomputer 440 stores the car layout information stored in the car layout information storage unit 460 in the display information storage unit 330 of the riding car display device 300 through the communicating unit 430. By this operation, the template information 11 stored in the display information storage unit 330 is stored in the display information storage unit 330 as the edited car layout information 12.

(Communication by Communicating Unit)

For the communicating unit 340 and the communicating unit 430, any communication method can be employed as long as it is able to transmit information regardless whether the form is wired or wireless.

(Maintenance Method 1)

The microcomputer 440 (an example of the reading unit) of the car layout information editing device 400 can read the car layout information stored in the display information storage unit 330 of the riding car display device 300 through the communicating unit 430 and store in the car layout information storage unit 460 (the editing side storage unit). The microcomputer 440 (an example of the writing unit) can write the read car layout information in the display information storage unit 330 of another riding car display device 300 which does not have the car layout information. This is the form which has been explained in FIG. 4. By this operation, the car layout information can be read from the faulty riding car display device 300*a* and written in the new riding car display device 300*new* for substitution without carrying out the editing operation.

(Maintenance Method 2)

Further, it is also possible to use a removable non-volatile storage for the car layout information storage unit 460 of the car layout information editing device 400 and the display information storage unit 330 of the riding car display device 300. This is the form which has been explained in FIG. 5. By this form, when either of the car layout information editing device 400 and the car layout information storage unit 460 has the car layout information, it is possible to easily mount the storage unit storing the car layout information to the device which does not have the car layout information.

By using either of the above "maintenance method 1" (corresponding to FIG. 4) and "maintenance method 2" (corresponding to FIG. 5), when the riding car display device 300*a* becomes faulty while operating, it is possible to easily set the existing car layout information to the new riding car display device 300*new*. In case of "maintenance method 1", the microcomputer 440 of the car layout information editing device 400 reads the car layout information from the faulty riding car display device 300*a* itself (if it is readable), or another riding car display device 300*b* storing the car layout information which is the same as the car layout information stored in the riding car display device 300*a* and writes the car layout information in the riding car display device 300*new*. Further, in case of "maintenance method 2", the worker can remove the removable non-volatile storage from the faulty riding car display device 300*a* and attach the removable non-volatile storage to the new riding car display device 300*new*.

FIG. 8 is a flowchart showing the processing operation of the car layout information of the riding car display device 300. FIG. 9 is a flowchart showing the processing operation of the car layout information of the car layout information editing device 400. The processing operation of the car layout information is done between the riding car display device 300 and the car layout information editing device 400 by carrying out mutual communication using the communicating unit 340 and the communicating unit 430, respectively. Here, the operation shown in FIG. 8 or FIG. 9 is an example, and the operation of the riding car display device 300 and the car layout information editing device 400 are not limited to the operation shown in FIG. 8 or FIG. 9.

(Operation of Riding Car Display Device 300)

Hereinafter, first, the processing flow will be explained based on FIG. 8. On starting the operation (start), the riding car display device 300

(1) At Step 1, displays an initial screen including necessary elements such as a background screen, etc. (display initial screen)

(2) Next, at Step 2, the microcomputer 350 discriminates the operation mode. The microcomputer 350, if the communicating unit 340 receives no sending/receiving request of the car layout information from the car layout information editing device 400, moves to the normal operation mode.

When a sending/receiving request of the car layout information is received from the car layout information editing device 400, the microcomputer 350 carries out the process from Step 3 (in case of a sending request) and the process from Step 9 (in case of a receiving request), respectively.

(In Case of Sending Request)

(3) At Step 3, when there exists the sending request of the car layout information (at this time, it is assumed to be template information 11), the microcomputer 350 sends the car layout information (the picture symbol, the coordinate position) of a template (necessary for editing) stored in the display information storage unit 330, and the relating information relating to the actual elevator (for example, A and characters show "A" car; the picture symbol of "_F_" shows "F" car) car to the car layout information editing device 400 through the communicating unit 340, and as well displays the sent car layout information (the template information 11) on the display unit 310.

(4) At Step 4, the microcomputer 350 discriminates if the transmission of the car layout information and the relating information has been finished, and continues the sending process until the transmission terminates.

(5) At Step 5, after the transmission of the car layout information and the relating information, the microcomputer 350 receives a display instruction (an edition instructing signal) from the car layout information editing device 400.

(6) At Step 6, according to the received display instruction, the microcomputer 350 carries out a displaying process corresponding to the display instruction (an editing process) on the car layout information displayed by the display unit 310 using the display controlling unit 320. The "display instruction" discussed here means a selecting instruction of the picture symbol, and a changing instruction, etc. of assigned coordinate of the picture symbol. Or, the display instruction also means an adding instruction of a new picture symbol or a new car identifying character, and a changing instruction, etc. of the coordinate of the new added picture symbol, etc. Or, the display instruction also means the selecting instruction of the picture symbol and a deleting instruction, etc. of the selected picture symbol. For example, according to the input from the editing operation inputting unit 410, the microcomputer 350 selects the picture symbol of which the coordinate position is a subject to be changed, and arranges the picture symbol at a desired position on the screen of the display unit 310.

(7) At Step 7, for the result of the displaying process at Step 6, the microcomputer 350 sends at least the changed amount of the car layout information (the template information 11) to the car layout information editing device 400 through the communicating unit 340.

(8) At Step 8, the microcomputer 350 repeats the processes of Step 5 to Step 7 until an "edition-completion instruction" showing the completion of edition sent from the car layout information editing device 400 is received.

(9) When the edition-completion instruction is received by the communicating unit 340 (Yes at Step 8), the microcomputer 350, at Step 9, receives the new updated car layout information sent from the car layout information editing device 400. After completing the receipt, the microcomputer 350 overwrites the old data (the car layout information) stored in the display information storage unit 330 with the new car layout information and stores the data.

(10) At Step 10, the microcomputer 350 carries out a restarting process, and displays the new car layout information on the display unit 310.

(11) Up to the above, the operation of the riding car display device 300 has been explained.

(Operation of Car Layout Information Editing Device 400)

FIG. 9 is a flowchart showing the operation of the car layout information editing device 400. With reference to FIG. 9, the operation of the car layout information editing device 400 will be explained.

When starting the operation (start), the car layout information editing device 400

(1) at Step 21, displays an initial screen including necessary elements such as a background screen, etc. (display initial screen); and (2) at Step 22, the microcomputer 440 selects the operation mode. When the microcomputer 440 edits and sends the car layout information to the riding car display device 300, and when the microcomputer 440 only sends the car layout information, the microcomputer 440 carries out:

the process from Step 23 (in case of editing the car layout information); and the process from Step 31 (in case of only sending the car layout information), respectively.

(In Case of Editing and Sending Car Layout Information)

(3) At Step 23, the microcomputer 440 sends the sending request which requests for sending the car layout information (the template information 11) stored in the display information storage unit 330 to the riding car display device 300 through the communicating unit 430. Then, the microcomputer 440 receives the template information 11 (the picture symbol, the coordinate position) which is necessary for editing and the relating information relating to the elevator car (for example, the car identifying character of "A" shows an "A" car; the picture symbol of "F" shows an "F" car) from the riding car display device 300, and as well discriminates if the receipt is completed (Step 24), and continues the receiving process until the receipt is completed. The microcomputer 440 stores the received information in the memory 450 for working and the car layout information storage unit 460 (Step 25).

(4) At Step 26, the microcomputer 440 processes operational signals (the selecting instruction of the picture symbol, the coordinate moving instruction) from the editing operation inputting unit 410 using the input controlling unit 420 and generates the "display instruction" (the edition instructing signal) for the riding car display device 300. Namely, at Step 26, the editing operation inputting unit 410 receives the editing operation for the car layout information which is the subject to be edited displayed by the display unit 310. On receiving the editing operation, the editing operation inputting unit 410 outputs the above operational signal corresponding to the editing operation. The microcomputer 440 generates the display instruction (the edition instructing signal) to instruct "the editing process corresponding to the operation signal outputted from the editing operation inputting unit 410" by using the input controlling unit 420. As discussed above (Step 6), the "display instruction" means a selecting instruction of the picture symbol, and a changing instruction, etc. of assigned coordinate of the picture symbol. Or, the display instruction also means an adding instruction of a new picture symbol or a new car identifying character, and a changing instruction, etc. of the coordinate of the new added picture symbol, etc. Or, the display instruction also means the selecting instruction of the picture symbol and a deleting instruction, etc. of the selected picture symbol. Namely, by the car layout information editing device 400, it is possible to add edition such as correction, addition, deletion of data, etc. on the car layout information displayed by the display unit 310 as the subject to be edited.

(5) At Step 27, the microcomputer 440 sends the display instruction to the riding car display device 300 through the communicating unit 430.

(6) As discussed in the explanation of Step 6, the riding car display device 300 carries out the displaying process (the editing process) according to the display instruction sent at Step 27. Then, at Step 28, the microcomputer 440 receives "the changed amount of the car layout information" from the riding car display device 300 after the displaying process by the riding car display device 300. The microcomputer 440 updates the car layout information (the template information 11) stored in the working memory according to the received changed amount of the car layout information.

(7) At Step 29, the microcomputer 440 discriminates whether or not to send the edition-completion instruction. Before sending the edition-completion instruction to the riding car display device 300, the microcomputer 440 repeats the above processes of Step 26 to 28. At the same time as sending "the edition-completion instruction" to the riding car display device 300, the microcomputer 440 overwrites the old data stored in the car layout information storage unit 460 with the new data of the car assignment and stores the new data.

(8) At Step 31, the microcomputer 440 sends the new car layout information stored in the car layout information storage unit 460 to the riding car display device 300 through the communicating unit 430.

(9) After the transmission, the process is completed.

(Implementation Example of Car layout information Editing System 1000 Using Elevator Hall Operation Board with Numeric Keypad)

FIG. 10 is a diagram showing an implementation example of the car layout information editing system 1000 using an elevator hall operation board 500 with a numeric keypad which is the destination information input device. FIG. 10 is a diagram showing an outer appearance of the elevator hall operation board 500 with the numeric keypad. A case in which a display unit 510 displays car layout information is shown. The elevator hall operation board with numeric keypad 500 is an elevator hall operation board having functions of the destination information input device 100, the riding car display device 300, and the car layout information editing device 400 in FIG. 1.

Namely, the elevator hall operation board with numeric keypad 500 includes:

a display unit 310;

a display information storage unit 330 storing at least one piece of car layout information;

a display controlling unit 320 displaying the car layout information on the display unit 310, and as well carrying out an editing process of the above car layout information displayed by the display unit 310 according to a display instruction;

an editing operation inputting unit 410 receiving the editing operation for the above car layout information displayed by the display unit 310; and an input controlling unit 420 generating the above display instruction to instruct the editing process corresponding to the above editing operation received by the editing operation inputting unit 410 and sending the generated display instruction to the display controlling unit 320.

The display controlling unit 320 and the input controlling unit 420 are implemented by a program and the microcomputer executing the program. The editing operation inputting unit 410 is implemented by the numeric keypad operating unit 520 which is used for inputting the destination floor as shown in FIG. 10.

By implementing the car layout information editing system 1000 using the elevator hall operation board with numeric keypad 500, in the system configuration as shown in FIG. 1, the destination information input device 100 (the elevator hall operation board with numeric keypad 500) includes functions of the destination information input device 100, the riding car display device 300, and the car layout information editing device 400, which accomplishes a simple system configuration.

In the elevator hall operation board with numeric keypad 500 of FIG. 10, using the numeric keypad operating unit 520, for example, the keys of "8", "2", "4", and "6" are respectively assigned to be operation keys for moving the picture symbol to up, down, left, and right, and the key "5" is assigned to be an operation key to decide. Here, the picture symbol 1 of the car, the picture symbol 2 of the operation board, the picture symbol 3 of the passage, etc. shown in the figure are examples, and the symbols are not limited to these.

In the foregoing first embodiment, the following system and devices have been explained.

(1) The car layout information editing system 1000 includes the riding car display device 300 and the car layout information editing device 400.

(2) The riding car display device 300 stores planar layout information (car layout information) of plural elevator cars at the elevator hall where services are provided by the plural elevator cars and displays a car to ride to the passengers.

(3) The car layout information editing device 400 can edit the car layout information.

(4) The riding car display device 300 previously stores plural patterns of the car layout information.

(5) The riding car display device 300 previously stores one or plural kinds of various picture symbols (an elevator car picture symbol, a picture symbol of the elevator hall riding car guiding device, a picture symbol of the passage, and a character symbol).

(6) The car layout information editing device 400 includes inputting means to select the car layout information or various picture symbols and decide the editing operation for the selected car layout information or the selected picture symbols.

(7) The car layout information editing device is implemented as the elevator hall operation board with numeric keypad.

Up to the above, a case of the car layout information editing system 1000 has been explained; it is possible to grasp the car layout information editing system 1000 as the car layout information editing method by grasping the operation of the car layout information editing system 1000 as steps. Similarly, it is possible to grasp the elevator hall operation board with numeric keypad 500 as the car layout information editing method by grasping the operation of the elevator hall operation board with numeric keypad 500 shown in FIG. 10 as steps of the respective configuration elements.

EXPLANATION OF SIGNS

Figure 1:
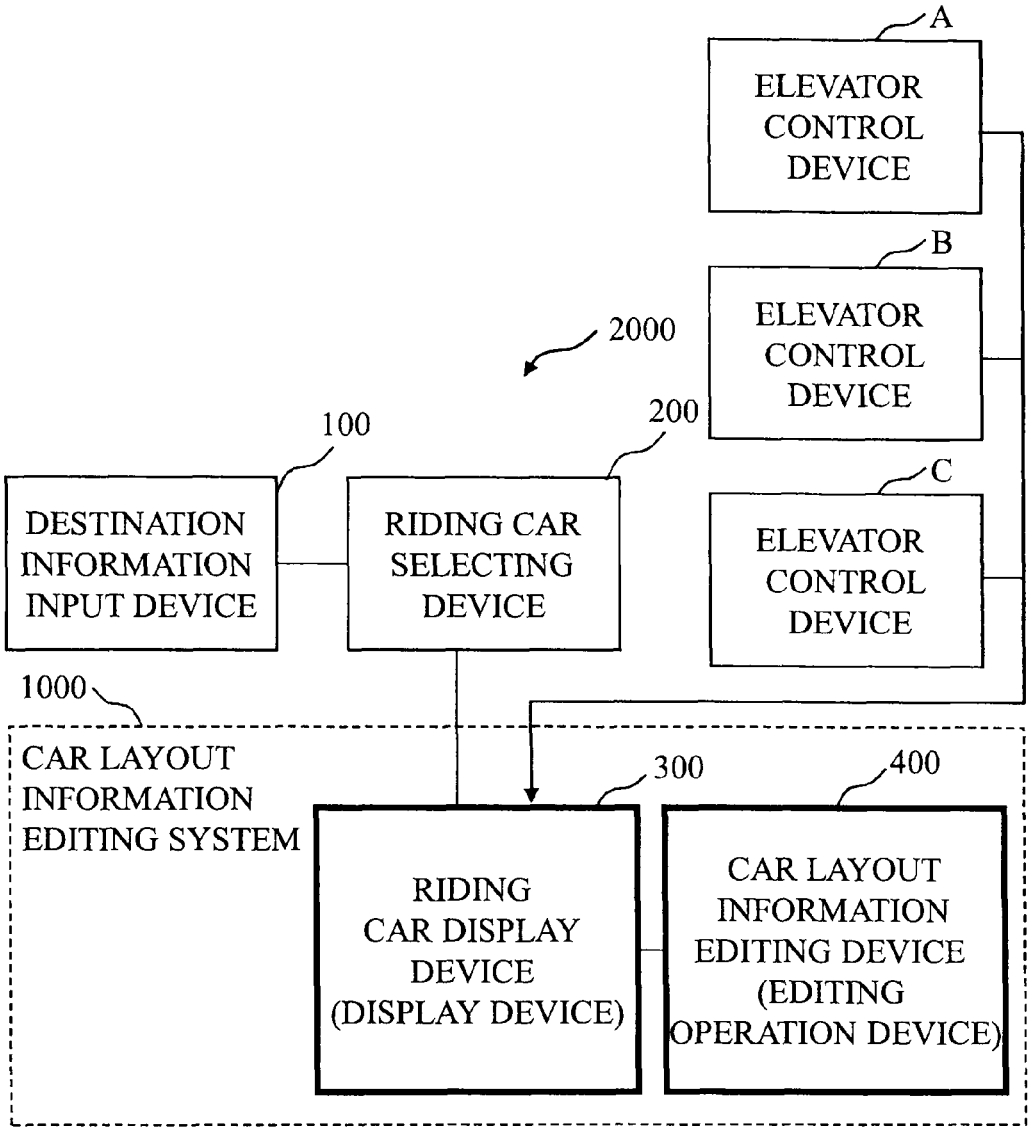
FIG. 1 is a configuration diagram of an elevator hall riding car guiding system 2000 according to the first embodiment.
Figure 2:
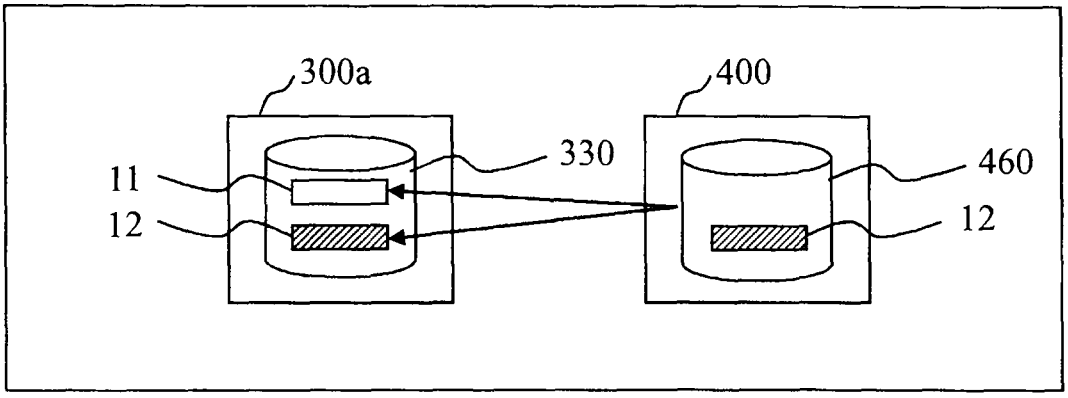
FIG. 2 shows the first utilization form of a car layout information editing system 1000 according to the first embodiment.
Figure 3:
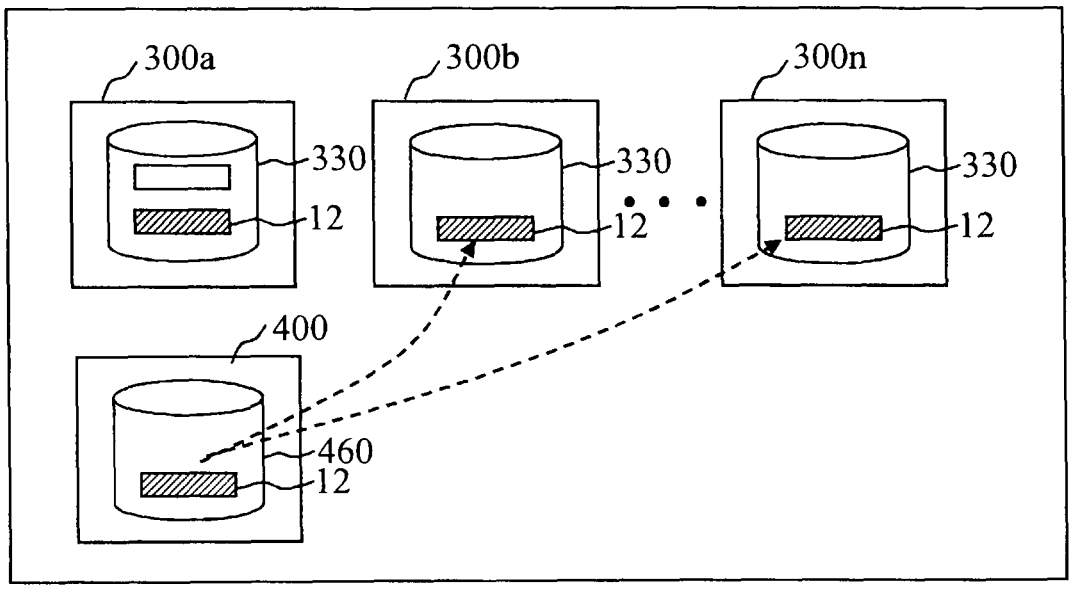
FIG. 3 shows the second utilization form of the car layout information editing system 1000 according to the first embodiment.
Figure 4:
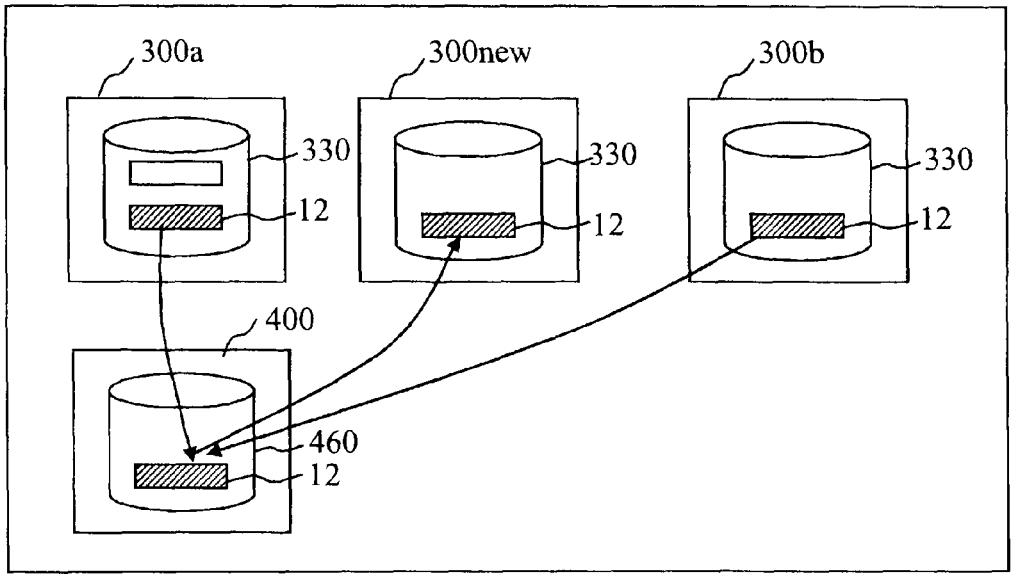
FIG. 4 shows the third utilization form of the car layout information editing system 1000 according to the first embodiment.
Figure 5:
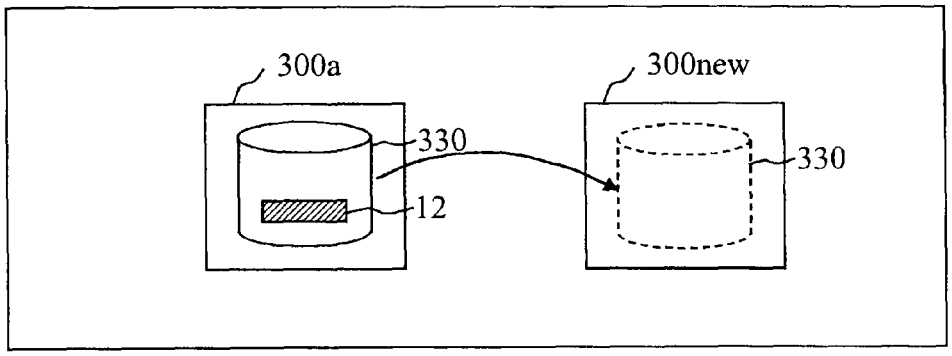
FIG. 5 shows the fourth utilization form of the car layout information editing system 1000 according to the first embodiment.
Figure 6:
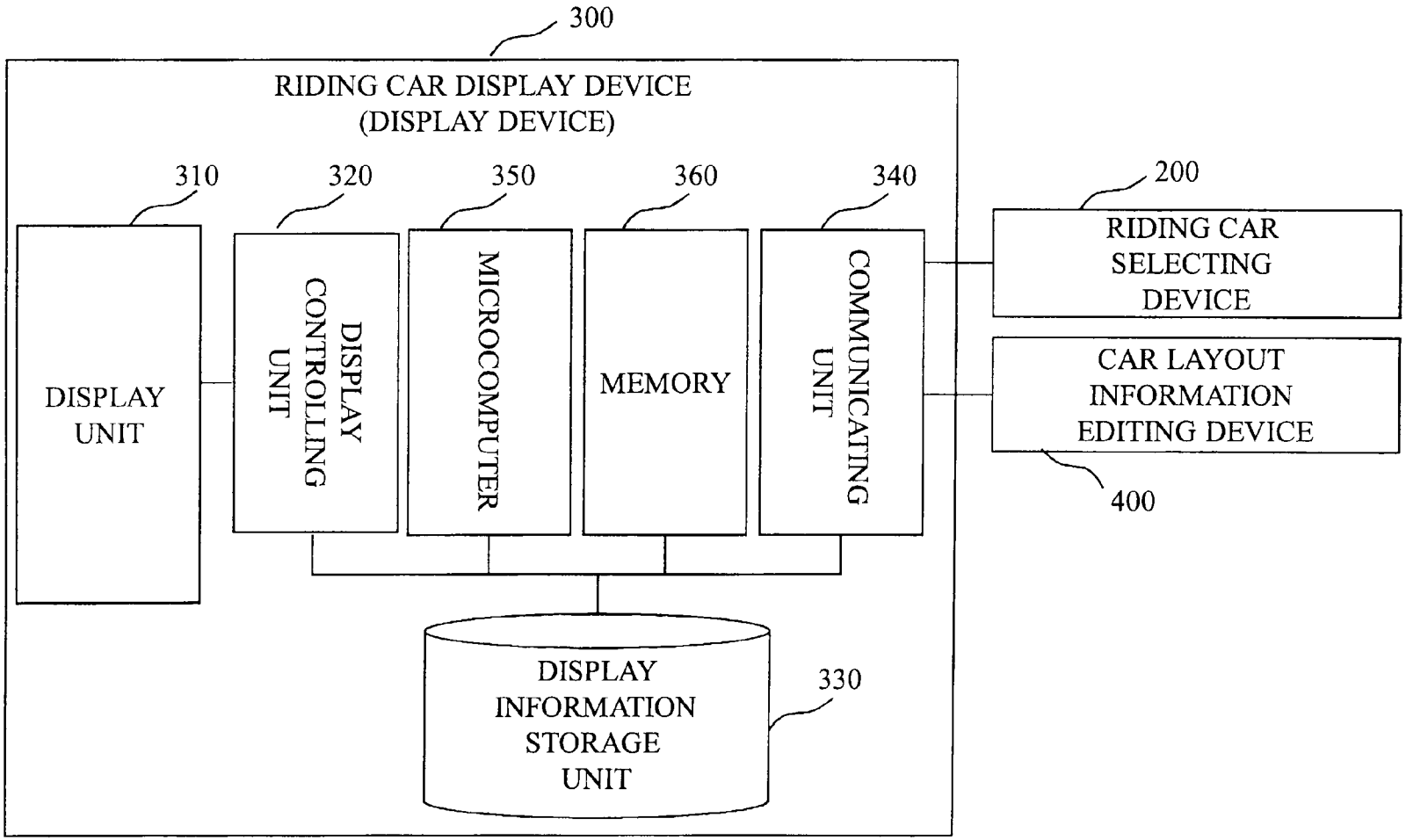
FIG. 6 is a block diagram of a riding car display device 300 according to the first embodiment.
Figure 7:
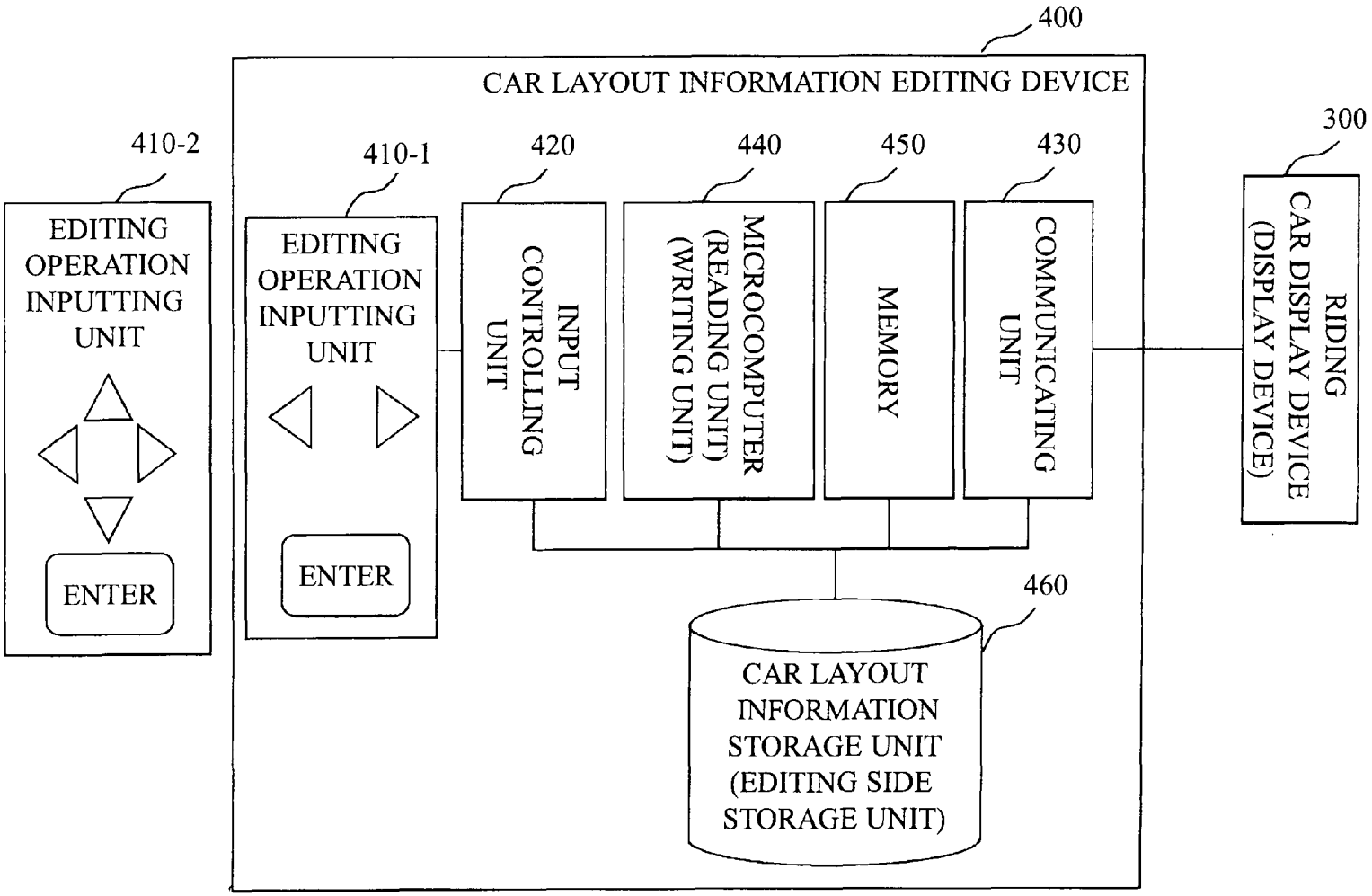
FIG. 7 is a block diagram of a car layout information editing device 400 according to the first embodiment.
Figure 8:
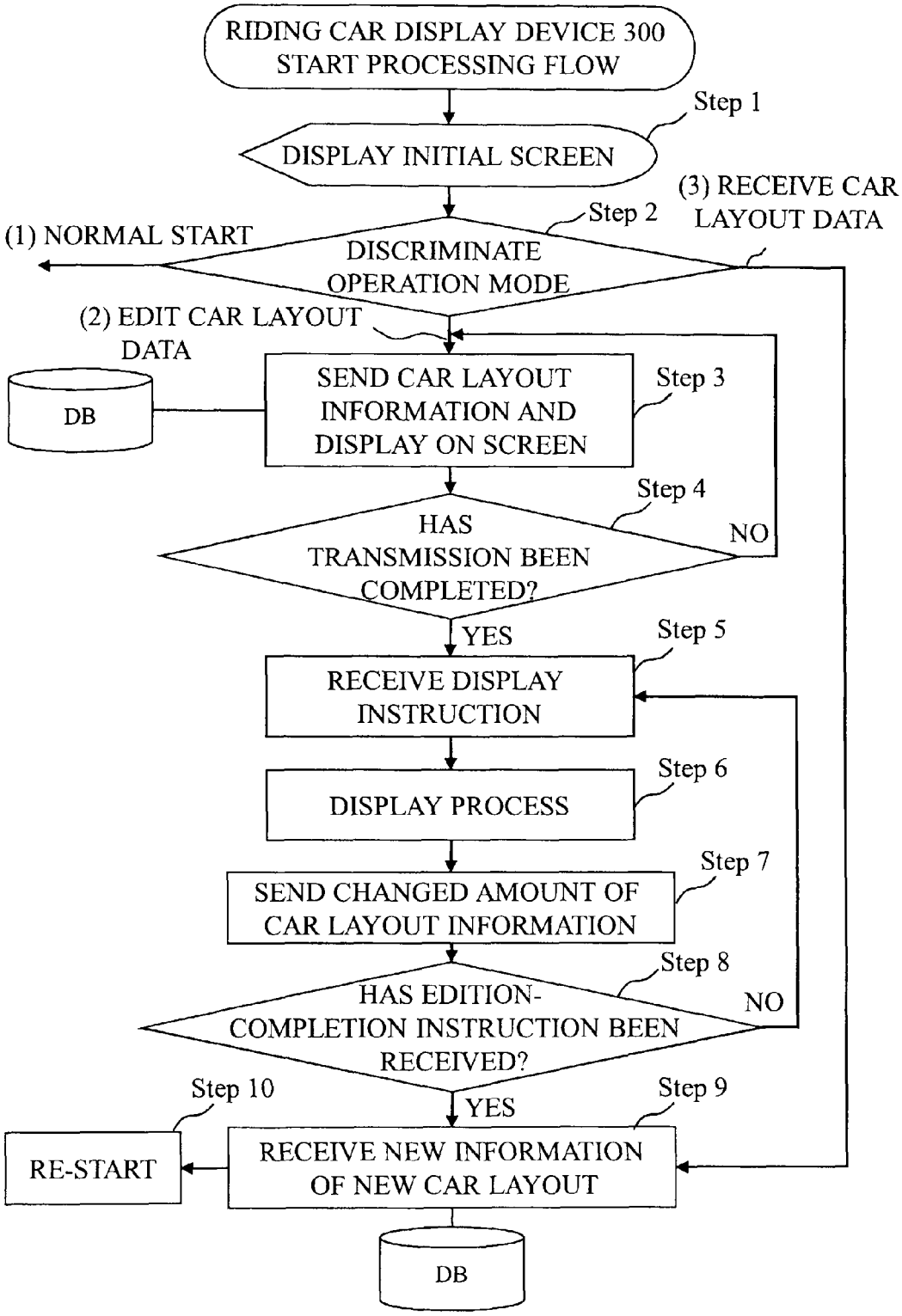
FIG. 8 is a flowchart showing the operation of the riding car display device 300 according to the first embodiment.
Figure 9:
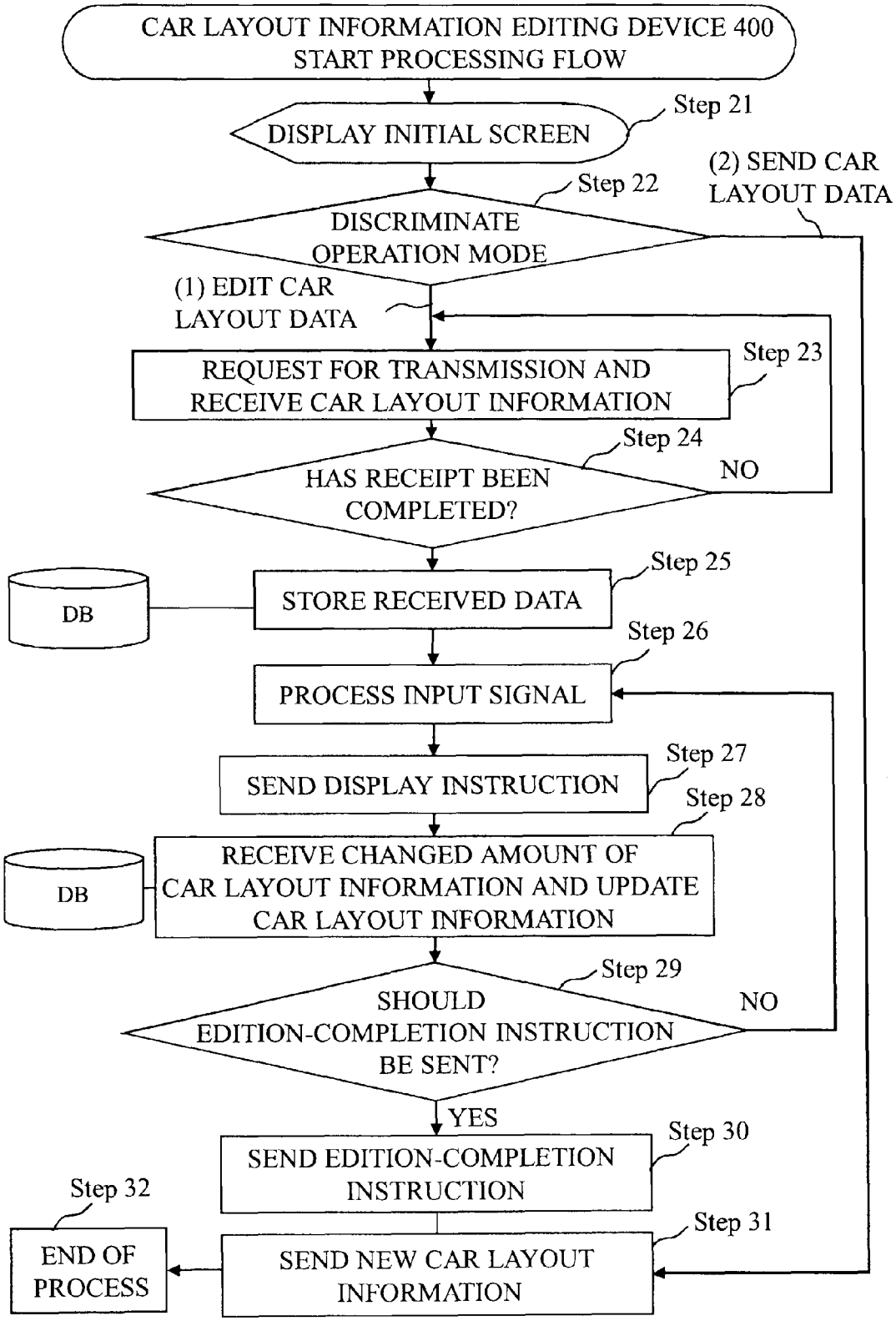
FIG. 9 is a flowchart showing the operation of the car layout information editing device 400 according to the first embodiment.
Figure 10:
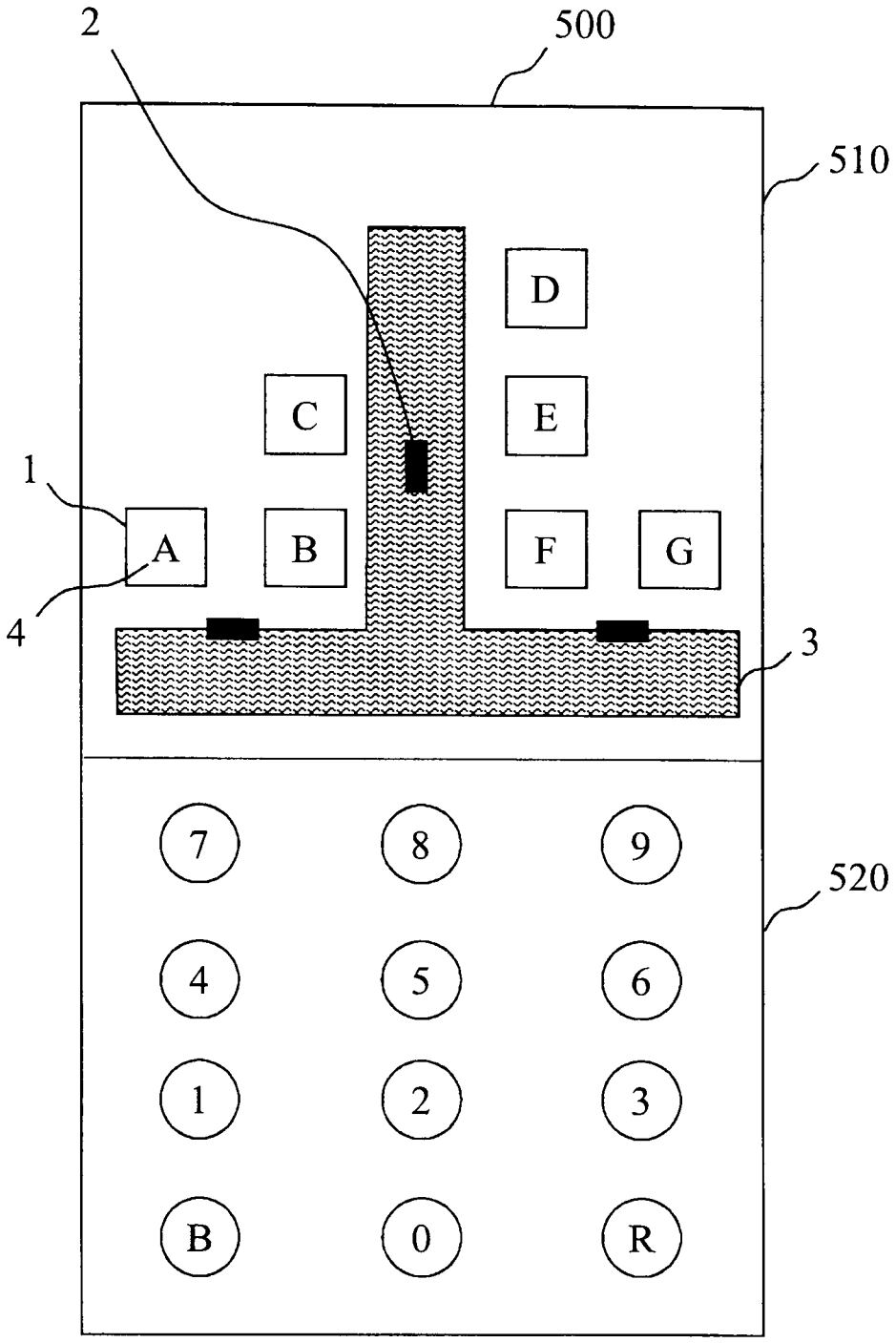
FIG. 10 shows an elevator hall operation board with numeric keypad according to the first embodiment.

1: a picture symbol of a car; 2: a picture symbol of an operation board; 3: a picture symbol of a passage; 4: a car identifying character; 11: template information; 12: car layout information; 100: a destination information input device; 200: a riding car selecting device; 300: a riding car display device; 310: a display unit; 320: a display controlling unit; 330: a display information storage unit; 340: a communicating unit; 350: a microcomputer; 360: a memory; 400: a car layout information editing device; 410, 410-1, and 410-2: editing operation inputting units; 420: an input controlling unit; 430: a communicating unit; 440: a microcomputer; 450: a memory; 460: a car layout information storage unit; 500: an elevator hall operation board with numeric keypad; 510: a display unit; 520: a numeric keypad operating unit; 1000: a car layout information editing system; and 2000: an elevator hall riding car guiding system.

The invention claimed is:

1. An elevator car layout information editing system comprising:

a display device including:

a display unit for displaying information;

a display information storage unit for storing at least one piece of car layout information showing planar layout of a plurality of elevator cars in a transverse section of a building as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information, and an editing operation device including:

an editing operation inputting unit for receiving an editing operation for the car layout information displayed by the display unit; and an input controlling unit for generating the edition instructing signal to instruct the editing process corresponding to the editing operation received by the editing operation inputting unit, and sending the edition instructing signal generated to the display controlling unit of the display device.

2. The elevator car layout information editing system of claim 1, wherein the display information storage unit stores the car layout information after the editing process which has been carried out by the display controlling unit, and wherein the editing operation device further comprises an editing side storage unit for storing car layout information which is same as the car layout information after the editing process stored in the display information storage unit.

3. The elevator car layout information editing system of claim 1, wherein the display information storage unit stores the car layout information after the editing process which has been carried out by the display controlling unit, and wherein the editing operation device further comprises:

an editing side storage unit for storing information; and a reading unit for reading the car layout information after the editing process stored in the display information storage unit, and storing the car layout information after the editing process which has been read in the editing side storage unit.

4. The elevator car layout information editing system of claim 2, wherein the editing operation device further comprises a writing unit, by connecting to a new one of the display device, for writing the car layout information after the editing process stored in the editing side storage unit in the display information storage unit of the new one of the display device.

5. The elevator car layout information editing system of claim 2, wherein the display information storage unit and the editing side storage unit are removable.

6. A destination information input device provided at an elevator hall receiving an input of a destination floor comprising:

a display unit for displaying information;

a display information storage unit for storing at least one piece of car layout information showing planar layout of a plurality of elevator cars in a transverse section of a building as display information to be displayed by the display unit;

a display controlling unit for displaying the car layout information stored in the display information storage unit by the display unit, and as well carrying out an editing process of the car layout information displayed by the display unit according to an edition instructing signal to instruct the editing process of the car layout information;

an editing operation inputting unit for receiving an editing operation for the car layout information displayed by the display unit; and an input controlling unit for generating the edition instructing signal to instruct the editing process corresponding to the editing operation received by the editing operation inputting unit, and sending the edition instructing signal generated to the display controlling unit.

7. A display device provided at an elevator hall displaying car layout information showing planar layout of a plurality of elevator cars in a transverse section of a building comprising:

a display unit for displaying information;

a display information storage unit for storing at least one piece of car layout information as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information.

8. An editing operation device comprising:

an editing operation inputting unit for receiving an editing operation for car layout information displayed by a displaying unit of a display device including:

the display unit for displaying information;

a display information storage unit for storing at least one piece of car layout information showing planar layout of a plurality of elevator cars in a transverse section of a building as display information to be displayed by the display unit; and a display controlling unit for displaying the car layout information stored in the display information storage unit by the display unit, and as well carrying out an editing process of the car layout information displayed by the display unit according to an edition instructing signal to instruct the editing process of the car layout information, and an input controlling unit for generating the edition instructing signal to instruct the editing process corresponding to the editing operation received by the editing operation inputting unit, and sending the edition instructing signal generated to the display controlling unit of the display device.

* * * * *